US005903938A

United States Patent [19]

Padilla

[11] Patent Number: 5,903,938

[45] Date of Patent: May 18, 1999

[54] COVER FOR THE UNDERSIDE OF THE TOP BED OF A BUNK BED

[76] Inventor: Rafael Padilla, 7419 W. 83rd St., Los Angeles, Calif. 90045

[21] Appl. No.: 09/196,333

[22] Filed: Nov. 19, 1998

Related U.S. Application Data

[63] Continuation of application No. 08/866,626, May 30, 1997, abandoned.

[51] Int. Cl.[6] ..... A47C 31/00; A47C 19/22

[52] U.S. Cl. ..... 5/8; 5/9.1; 5/658; 160/369

[58] Field of Search ..... 5/658, 9.1, 8, 907, 5/285; 160/371, 377, 369

[56] References Cited

U.S. PATENT DOCUMENTS

| | | | |
|---|---|---|---|
| 3,563,599 | 2/1971 | Heumann | 5/907 |
| 5,211,214 | 5/1993 | Shaw | 160/369 |
| 5,568,832 | 10/1996 | Eddy | 160/374 |
| 5,706,878 | 1/1998 | Guettler | 160/330 |

FOREIGN PATENT DOCUMENTS

| | | | |
|---|---|---|---|
| 2172198 | 3/1986 | United Kingdom | 5/907 |

*Primary Examiner*—Alex Grosz
*Attorney, Agent, or Firm*—Kelly Bauersfeld Lowry & Kelley, LLP.

[57] ABSTRACT

A furnishing to cover and substantially conceal the underside of a top bunk bed comprises a generally rectangular frame and a sheet affixed to the frame. The interchangeable sheet has sleeved borders with slits in the corners for the insertion of side-support members, end-support members, and corner joints of the rectangular frame. The sheet may be embellished with artwork, characters or designs, and may have apertures to accommodate mechanisms for hanging or attaching the frame and sheet to the underside of the top bunk bed.

16 Claims, 2 Drawing Sheets

COVER FOR THE UNDERSIDE OF THE TOP BED OF A BUNK BED

RELATED APPLICATION

This application is a continuation of U.S. patent application Ser. No. 08/866,626, filed May 30, 1997, now abandoned.

BACKGROUND OF THE INVENTION

The present invention relates to furnishings, specifically to furnishings used to cover or conceal the underside of a top bed of a bunk bed assembly. The contents of the underside of the top bunk bed, such as springs, boards, mattress, and other structural members have traditionally been exposed to the view of the individual occupying the lower bunk bed. This sight is unpleasant, and at times is distracting and even upsetting for the individual, especially a child who occupies the lower bunk bed. In addition, since the underside of the top bunk is exposed, it may accumulate dirt and needs to be cleaned from time to time.

Accordingly, the present invention is intended to address these problems by providing an inexpensive, visually attractive, easy to install, and interchangeable covering for the underside of the top bunk bed.

SUMMARY OF THE INVENTION

The present invention relates to a cover on the underside of a bunk bed. A furnishing or cover, adapted to conceal the bottom of the top bed in a bunk bed assembly is comprised of a generally rectangular frame (the shape of the frame designed to conform to the shape of most bunk beds) and a sheet of material with a sleeved edge portion to affix the sheet to the frame. Holes are provided in the sheet to accommodate hanging mechanisms to hang or attach the sheet and frame combination to the underside of the top bunk.

The generally rectangular frame preferably includes: corner joints, side-support members, and end-support members. Alternatively, connection joints can be utilized to lengthen or shorten the dimensions of the frame. The side-support members are connected to the end-support members by the corner joints, forming a substantially rigid rectangular frame. As another alternative, the rectangular frame may be constructed by a single continuous piece of suitable material.

The sheet which may be made of a variety of suitable materials, examples of which are cloth or plastic, is preferably rectangular in shape (to conform to the shape of the frame and most bunk beds), and has sleeved edges to allow the sheet to be affixed to the frame. Slits are placed in the corners of the sleeved edges for insertion of members of the frame through the sleeves. The sheet is preferably provided with apertures to allow the cover to be hanged or otherwise affixed to the underside of the top bunk by utilizing various mechanisms for hanging articles known in the art. The sheet may also be embellished with a design or artwork (e.g., cartoon characters, scenery) for aesthetic appeal and to provide comfort to the occupant of the lower bunk bed.

As can be seen from the foregoing description, an inexpensive and simple furnishing is produced which conceals the unsightly underside of the top bunk bed by a visually attractive cover that may also serve to soothe and entertain the occupant of the lower bunk bed. Other features will become apparent from the following detailed description, taken in conjunction with the drawings which illustrate, by way of example, the principles of the invention.

DETAILED DESCRIPTION OF THE PREFERRED EMBODIMENTS

Figures 1, 2, 3:
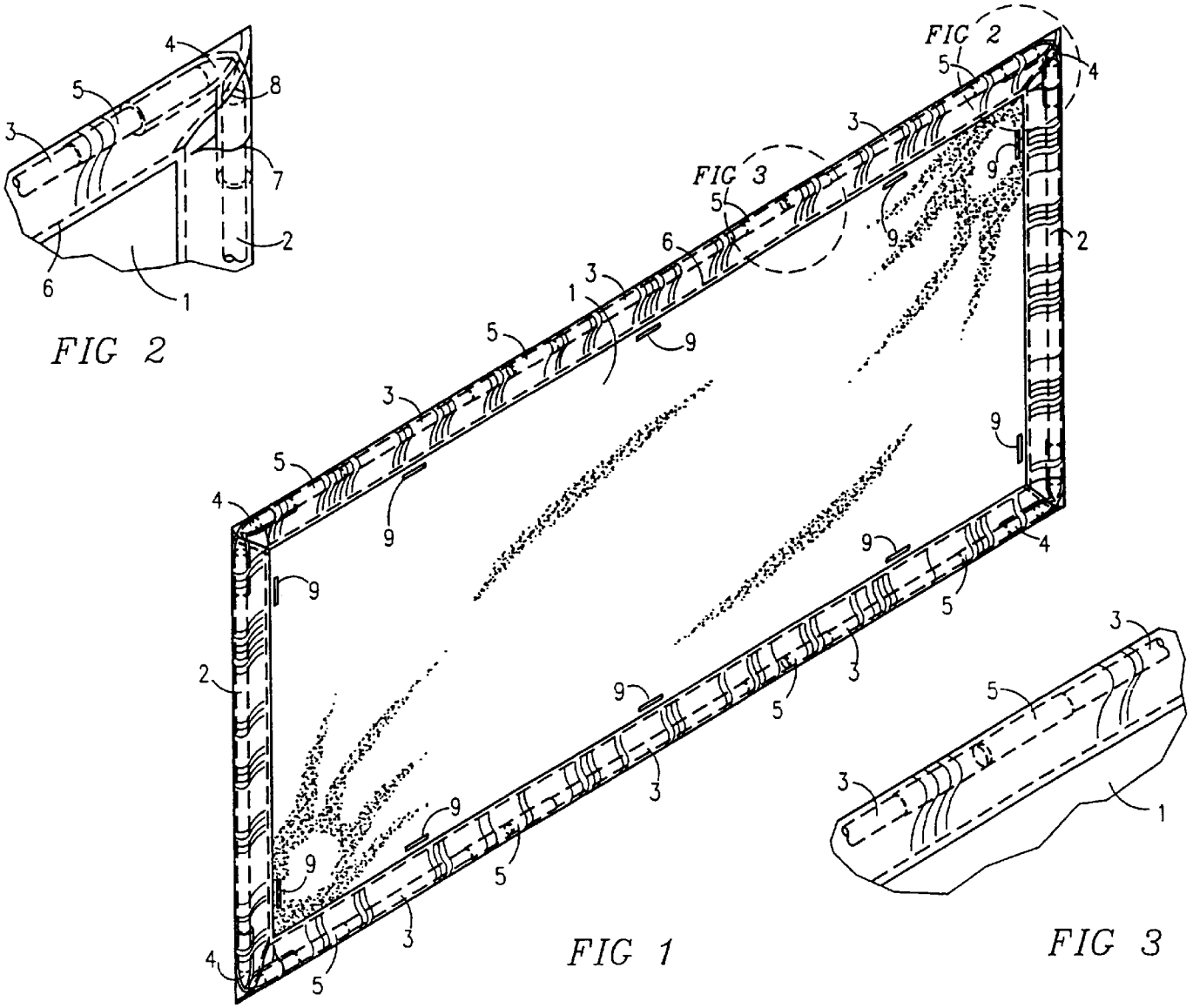
FIG. 1 is a perspective view of a furnishing, illustrating a sheet of material affixed to a rectangular frame according to the present invention.
FIG. 2 is an enlarged view of a corner of FIG. 1, illustrating a sleeved edge of the sheet having slits.
FIG. 3 is an enlarged view of a sleeved edge of FIG. 1, containing side-support members of the frame.
Figures 4, 5, 6, 7:
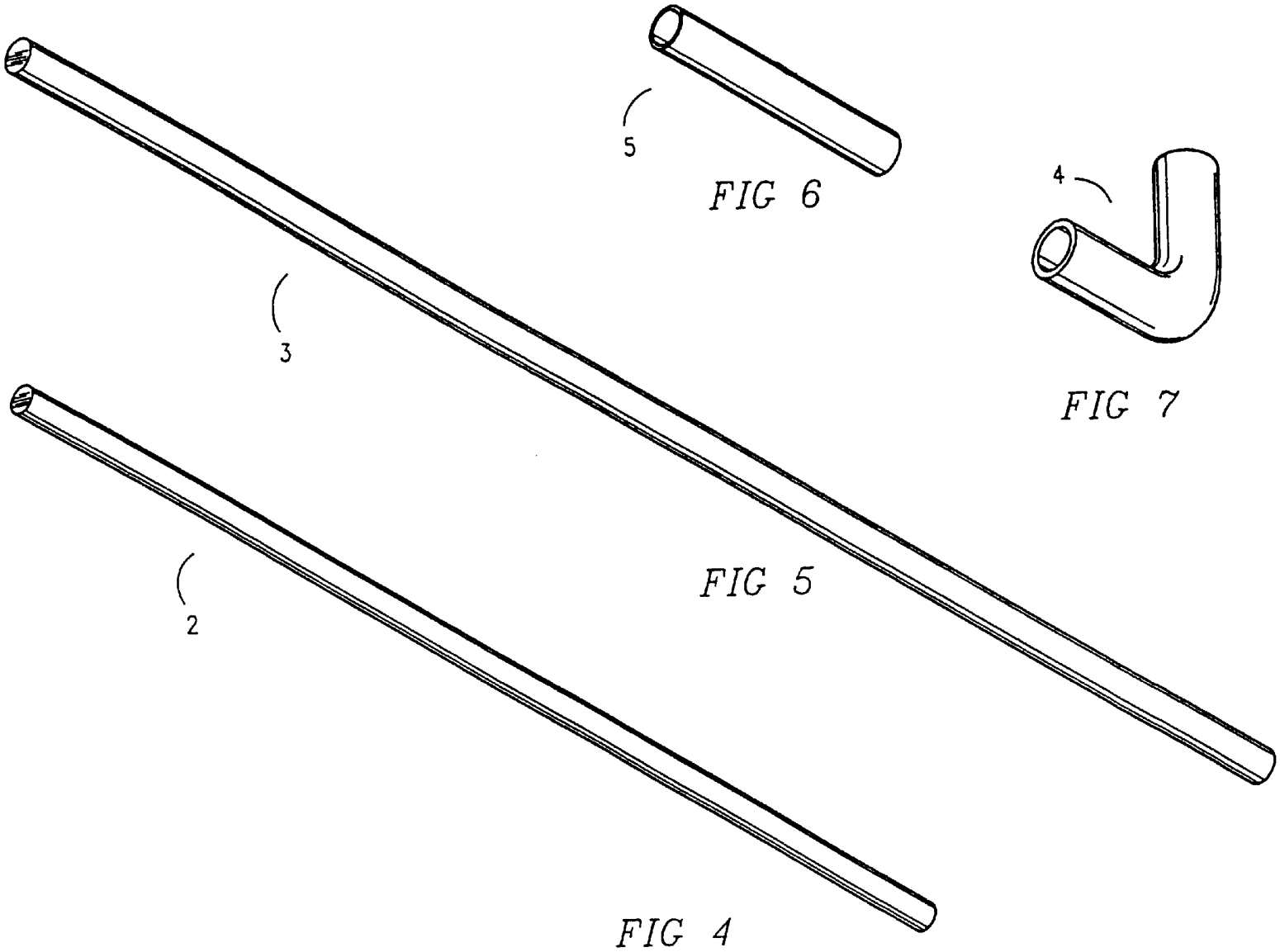
FIG. 4 is a perspective view of an end-support member of the frame.
FIG. 5 is a perspective view of a side-support member of the frame.
FIG. 6 is a perspective view of a side joint member of the frame.
FIG. 7 is a perspective view of a corner joint member of the frame.

As shown in the drawings for purposes of illustration, the present invention is concerned with a furnishing or cover 10 for the underside of a top bunk bed (not shown). As shown in FIG. 1, the cover 10 preferably includes a generally rectangular frame comprised of end-support members 2, side-support members 3, and corner joints 4. These frame members may be made of plastic, wood, metal or any other suitable and lightweight material that is capable of forming a substantially rigid frame structure.

A sheet 1 is provided to affix to the frame. The sheet 1 includes a sleeve 6 formed by folding the perimeter edges 14 of the sheet 1 and stitching the folded edges 14 to the sheet 1 along stitching lines. Alternatively, the perimeter edges 14 may be affixed to the sheet 1 by other methods of fastening, such as be utilizing corresponding hook and loop elements commercially known by the trademark VELCRO. As shown in FIG. 2, a slit 7 in the sleeve 6 is provided in the corners of the sheet 1 for the placement of the individual members of the frame in the sleeve 6. The sheet 1 is provided with apertures 9 to allow the cover 10 to be hanged or otherwise affixed to the underside of the top bunk bed. For example, plastic tie straps may be looped through the apertures 9 and around springs or other fixed position structural members on the underside of the top apertures 9 and around springs or other fixed position structural members on the underside of the top bunk bed. Alternatively, while it is not shown, the frame may be hanged from or affixed to the underside of the top bunk bed by various methods known by those skilled in the art (e.g., by attaching the four corners of the frame to the underside of the top bed by cable ties, hooks, straps, and many other methods). Thus a method of covering the bottom of the top bed in a bunk bed assembly is described. Broadly, the method comprises the steps of providing a furnishing comprised of a frame having a cover affixed thereto, and attaching said furnishing to the bottom of the top bed of a bunk bed assembly. The sheet 1 may be formed from any suitable and lightweight material, such as cloth or plastic, and may be embellished with designs, artwork, or characters which are pleasing to the eyes and may act to soothe and comfort the child occupant of the lower bunk bed. For example, if the occupant of the lower bunk bed is a child, a picture of his or her favorite cartoon character or athlete may be printed on the sheet. With the present invention, the sheet 1 may be easily removed and replaced by another sheet with a different design.

Referring to FIG. 3, a portion of the sheet 1 with the sleeve 6 is shown with side-support members 3 connected by a side joint member 5 inside the sleeve 6. In this manner instead of using long side-support members 3, several shorter side-support members 3 may be joined together for use in a longer bunk bed. Similarly, by using several side-support members 3 on each side of the frame, the frame may be adjusted to fit a smaller bunk bed by removing some of the side-support members 3. Preferably, as shown in FIGS. 4–7, the frame members are made of PVC tubing, and are appropriately sized in various diameters so as to interconnect with one another by slight force to press fit the tubings together to form a frame with desired dimensions.

It is understood that a variety of modifications to the present invention will be apparent to persons skilled in the art without departing from the scope and spirit of the invention. Accordingly, no limitation on the invention is limited by way of the foregoing description and accompanying drawings which are for purposes of illustration, except as set forth in the following claims.

What is claimed is:

1. A furnishing, adapted to substantially cover the bottom of the top bed in a bunk bed assembly, said furnishing comprising:

a generally rectangular frame;

a cover comprising a sleeve portion adapted to hold said frame; and holes provided in said cover, said holes adapted to accommodate hanging mechanisms, whereby the furnishing may be attached to the bottom of the top bed of a bunk bed assembly.

2. In combination with a bunk bed assembly, a furnishing, adapted to substantially cover the bottom of the top bed of the bunk bed assembly, said furnishing comprising:

a generally rectangular frame; and a cover affixed to said frame to form a frame and cover assembly, said frame and cover assembly adapted for attachment to the bottom of the top bed.

3. The furnishing of claim 2, wherein said cover is removably affixed to said frame.

4. The furnishing of claim 2, wherein said frame and cover assembly is removably attached to the bottom of the top bed.

5. The furnishing of claim 2, wherein said cover includes sleeved borders to accommodate said cover to be affixed to said frame.

6. The furnishing of claim 5, wherein said sleeved borders of said cover include slits to accommodate said cover to be affixed to said frame.

7. The furnishing of claim 5, wherein said sleeved borders are formed by stitching.

8. The furnishing of claim 2, wherein said cover is affixed to said frame by hook and loop elements.

9. The furnishing of claim 2, wherein said cover is embellished with a visual design.

10. The furnishing of claim 2, wherein said cover includes a plurality of apertures to accommodate attachment of said frame and cover assembly to the bottom of the top bed.

11. The furnishing of claim 2, wherein said frame includes a plurality of interconnected support members.

12. The furnishing of claim 11, wherein said support members are tubular shaped members.

13. The furnishing of claim 2, wherein said frame is constructed of a single continuous support member.

14. The furnishing of claim 2, wherein said frame can be adjusted to accommodate at least two desired lengths.

15. The furnishing of claim 2, wherein said frame can be adjusted to accommodate at least two desired widths.

16. A method of covering the bottom of the top bed in a bunk bed assembly, said method comprising the steps of providing a furnishing comprised of a frame having a cover affixed thereto, and attaching said furnishing to the bottom of the top bed of said bunk bed assembly.

* * * * *